US005952985A

United States Patent [19]

McKinney et al.

[11] Patent Number: 5,952,985

[45] Date of Patent: Sep. 14, 1999

[54] UPDATE METHOD FOR DISPLAYING HIGHLY DYNAMIC EVENTS IN MULTIPLEXED CHARACTER DISPLAYS

[75] Inventors: Steven J. McKinney, Tamarac; Frank R. Aiello, Jr., Lake Worth, both of Fla.

[73] Assignee: Core Engineering, Inc., Boca Raton, Fla.

[21] Appl. No.: 08/699,157

[22] Filed: Aug. 16, 1996

Related U.S. Application Data

[60] Provisional application No. 60/003,469, Sep. 7, 1995.

[51] Int. Cl.[6] ..... G03G 15/00

[52] U.S. Cl. ..... 345/42; 345/33; 345/34; 345/47; 345/51

[58] Field of Search ..... 345/33, 34, 42, 345/47, 51, 141, 74, 75

[56] References Cited

U.S. PATENT DOCUMENTS

| | | | |
|---|---|---|---|
| 3,849,979 | 11/1974 | Tanji | 368/68 |
| 4,194,352 | 3/1980 | Terzian | 368/239 |
| 4,205,516 | 6/1980 | Terao | 345/33 |
| 4,408,869 | 10/1983 | Tomosada et al. | 345/34 |
| 5,162,789 | 11/1992 | Moriya et al. | 340/814 |
| 5,808,590 | 9/1998 | Kawasaki et al. | 345/47 |
| 5,844,531 | 12/1998 | Betsui | 345/75 |

*Primary Examiner*—Mark R. Powell
*Assistant Examiner*—Vincent E. Kovalick
*Attorney, Agent, or Firm*—Graham & James LLP

[57] ABSTRACT

A method of updating characters within a multiplexed display used for displaying events including dynamic events which occur at a relatively faster rate. The display characters representing dynamic events are refreshed at a higher refresh frequency and more frequently during each display cycle. A plurality of display drivers including at least one grid driver controls the update and enablement of characters within the multiplexed display.

8 Claims, 8 Drawing Sheets

| REFRESH SLICE | CHARACTER TO ENABLE | GRID SHIFT PATTERN (DATA/CLOCKS, DATA/CLOCKS, DATA/CLOCKS) |
|---|---|---|
| 1 | 1 | 1/1 |
| 2 | 2 | 0/1 |
| 3 | 3 | 0/1 |
| 4 | 5 | 0/2 |
| 5 | 4 | 1/1 • 0/3 |
| 6 | 2 | 0/2 • 1/1 • 0/1 |
| 7 | 6 | 0/4 |
| 8 | 5 | 1/1 • 0/4 |
| 9 | 7 | 0/2 |

60 72

UPDATE METHOD FOR DISPLAYING HIGHLY DYNAMIC EVENTS IN MULTIPLEXED CHARACTER DISPLAYS

This application claims the benefit of U.S. Provisional Application No. 60/003,469, entitled "Non-sequential Grid Update Method For Displaying Highly Dynamic Events In Multiplexed Segment Vacuum Fluorescent Displays," filed Sep. 7, 1995, which is hereby incorporated by reference.

FIELD OF THE INVENTION

The present invention relates to methods for updating data in multiple character, time-multiplexed displays. More particularly, the present invention relates to a non-sequential grid update method for displaying highly dynamic events in multiplexed segment vacuum fluorescent displays.

BACKGROUND INFORMATION

Vacuum Fluorescent Displays (VFDs) are commonly used for displaying system status or providing feedback to a user during the setup or the operation of a system. VFDs are voltage controlled devices. VFDs are controlled and driven by a variety of display drivers that regulate and drive the grids and anodes (plates) of the display. Display drivers are typically serial input, parallel output shift registers designed with high voltage output driver stages which are suitable for driving the anodes and grids of the displays. Output pins usually number 8, 32 or 35. Numerous drivers may operate together and can be configured to drive and control a wide range of VFDs.

By applying an AC waveform across the filament of the VFD, electrons become excited and are emitted. If both the grid and the anode are driven to a high positive voltage with respect to the cathode, the electrons reach the anode area. When bombarded by electrons, this fluorescent coated area, typically comprising a portion or "segment" of the display, emits light. As a result, this segment in the display is turned on and becomes visible to a system user.

There are two display driving methods commonly employed. In displays containing a relatively small number of segments (typically less than or equal to 70), a simple direct driving scheme is used. FIGS. 1A–B illustrate the direct driving method. In a four character display 2 consisting of 8 segments per character 4 (including decimal point), as shown in FIG. 1A, each segment requires its own segment plate input. In the direct driving method, each segment's anode is uniquely wired to a driver output pin 6, with drivers 8 cascaded until there are enough bits to drive all the segments. For example, two 32-bit drivers may be cascaded in order to form a 64-bit direct driving circuit as illustrated in FIG. 1B. Cascading is accomplished by connecting the serial data output pin of the first driver 7 to the serial data input pin of the second driver 9. The advantage of this method is that no display refresh is required, and the controlling microprocessor or circuitry 10 need only update the display 2 when the data changes. The disadvantage is that one plate driver output 6 is required for every segment which can lead to an undesirably large number of drivers 8 in displays containing a large number of segments.

In applications with many display segments, the number of drivers required to directly drive the display can become prohibitively large. For example, in a 32 character 5×7 dot matrix display, a total of 1120 segments must be driven which would require 32 35-segment drivers. In these cases, a multiplexing scheme is commonly employed. The displays designed for multiplexing contain groups of segments, each of which are controlled by individual grids. For example, in the 5×7 dot matrix display, each 35 segment character is controlled by a separate grid. The anodes of the first segment in each character are wired together, as are the anodes of the second, the third, and so on. Using a time-multiplexing scheme, the 1120 segment dot matrix display can be driven with one 32 bit device driving the 32 character grids, and one 35 bit device driving the corresponding 35 segments in each character. The advantage of this method is that it reduces the number of drivers required from 32 to 2. However, the disadvantage is that data must be refreshed for each character in a multiplexed display regardless of whether the data has changed since the segments in each individual character are not uniquely wired to a separate driver output pin.

As another example of a display for 8 segment characters (including decimal point), FIG. 2 illustrates this multiplexed wiring technique in a four character (32 segments) display 14. The anodes for selected groups of segments are hard-wired together resulting in 8 segment plate wires 18. A plate driver (not shown) with eight driver outputs controls the connected anodes. At the same time, each grid 20 within the four character display 14 is driven by a grid driver (not shown). Each grid driver line 22 is identified as Grid #1 through Grid #4. As a result, the multiplexed four character display 14 in FIG. 2 with 32 segments is controlled with only a total of 12 lines 18 and 22.

The multiplex timing of a VFD display is then similar to that of an LED display. As shown in FIG. 3, the plate 24 and grid drivers 26 for a 32 character multiplexed segment VFD 28 may be controlled by the display microprocessor 30 or some other controlling circuitry. The serial data 34 and clock lines 32 of a single 32 segment grid driver 26 may be connected with the control ports 36 of the microprocessor 30. A similar interface may be created between the microprocessor 30 and the plate driver 24 as well. Each display driver 24 and 26 operates off of separate clocks 38 and 40 to output serial data for each driver at predetermined time intervals. In the multiplexed timing of a VFD 28, plate segment data 42 for one character 44 is first output to the display. Next, the digit strobe (grid enable) 46 for that character is driven high, enabling only that character. At the same time, all other characters wait in turn to be enabled. The digit strobe is then brought low while the segment data is changed to the desired information for the next character on the display. This character is then enabled by driving its respective grid high. Again, all other display characters are not enabled yet. This action continues until each character within a display is turned on sequentially. After all of the characters have been enabled, the cycle starts over.

FIG. 3 shows the typical architecture for driving a multiplexed display, while FIG. 4 is a simplified timing illustration for the display. As shown in FIG. 4, each grid within the VFD may be arranged in order and identified as grid 1 through grid 32. Plate driver data for each character may also be identified as character #1 transitioning through and ending with character #32. FIG. 4 illustrates the sequential character enable scheme for each character within the display 28 as determined by the serial data for each respective grid being clocked in by the grid clock 38 in order to sequentially drive each grid high at selected time intervals.

Additionally, in order to prevent undesirable ghosting effects during the transition between character enables or stable segment data 47, a blank signal 50 is activated at appropriate time intervals when segment data is being changed 48. Immediately after each character enable, the display microprocessor or controlling circuitry 30 activates a blank signal 50 to blank the entire display 28. In order to compensate for the temporal difference between driving a grid high for a character, and then bringing it low for the next character enable, a blank signal 50 is used to clear the display 28 and minimize any ghosting effect remaining from a previous character enable.

Each time a character in a multiplexed display is enabled, its data is "refreshed." This refresh occurs periodically, and must be at a rate sufficient to eliminate the perception of flickering by the human eye. The maximum refresh rate is dependent on the speed of the driving circuit, and the computing overhead involved. The minimum rate required to eliminate flickering is about 50 times per second (Hz). A rate of about 100 Hz is typical. Because multiplexed displays are constantly being updated to conform to the refresh of each character as required by the architecture, any change in the data to be displayed is simply incorporated in the next refresh cycle. An event change which is to be displayed is recorded, the stored segment data is updated, and on the next refresh cycle, the new data will be written to the display. Again, each character within the display is enabled and turned on sequentially during every refresh cycle. This scheme works well until the rate of change of a displayed event approaches the refresh frequency. When this occurs, it is possible that the changed data will change again before a refresh cycle is complete, causing the event to go completely undisplayed. An example of this problem may occur when using a multiplexed VFD display to display a highly dynamic event such as the access condition of a Hard Disk Drive (HDD). This access condition is most commonly displayed by directly driving an LED (or VFD) with the access signal from the HDD. HDD accesses then cause the LED to illuminate during the access time, and turn off when the drive is not being accessed. The resulting flicker of the LED is a desired outcome which represents the highly dynamic nature of the event. Duplicating this dynamic flicker in a multiplexed display can be difficult. One solution involves using a software algorithm to integrate (slow down the frequency of) the access indication before it is passed to the display data memory. This integrated form of the data which has a slower rate of change than the display refresh rate, can then be displayed successfully. The disadvantage of this software integration method, is that it can use up valuable computer or controller memory code space. This memory can be extremely limited in cases incorporating a simple micro-controller to perform the display refresh and event sampling tasks. Also, the longer it takes to perform the event integration operation, results in less time left to perform the display refresh function. As stated before, if the refresh rate becomes too slow, the entire display can appear to flicker.

Accordingly, it will be appreciated that a need presently exists for a method of updating and refreshing data for highly dynamic events in a multiplexed segment display. More particularly, it will be appreciated that a need presently exists for a method of updating data in multiplexed displays when the rate of change for a displayed event approaches the refresh frequency. It will be further appreciated that there currently exists a need for a multiplexed display that includes characters representing highly dynamic events which are cable of being updated at a different frequency when compared to other display characters.

SUMMARY OF THE INVENTION

The present invention provides a method by which characters representing dynamic events may be refreshed at a relatively higher rate than that of other characters within a display. It will be appreciated that for the purpose of the present invention, characters representing highly dynamic, or more rapidly changing events will be referred to herein as dynamic characters, while static or more slowly changing characters within a display will be identified as relatively non-dynamic characters. During a single refresh cycle, segment data for all characters within a display may be updated to some degree. However, dynamic characters are updated more frequently than those of non-dynamic characters.

In one preferred method of the present invention, display characters within a multiplexed segment vacuum fluorescent display are non-sequentially updated by a plate driver and a single (non-discrete) grid driver. Each character is enabled by first outputting its respective segment data to display, and then driving the grid for that character high. However, dynamic characters are non-sequentially enabled and refreshed at a higher frequency than non-dynamic characters during every display cycle. Each time a character within the multiplexed display is enabled, its respective grid shift data pattern is registered in order to have each grid within a display driven at appropriate time intervals by the grid driver. A grid shift register contains the appropriate number of cells to store the data pattern which determines which grid is to be enabled.

In another implementation of the present invention, a vacuum fluorescent display may be driven by more than one grid driver. Non-dynamic characters may be enabled through one grid driver while dynamic characters are controlled by one or more discrete grid drivers. It will be appreciated that additional grid drivers require more control port connections with the display microprocessor. Multiple grid drivers operate together in order to perform the non-sequential update method for both dynamic and non-dynamic characters.

In another variation of the present invention, a multiplexed segment vacuum fluorescent display may be used to indicate a highly dynamic event such as the access of a hard-disk drive as indicated on a computer display panel. The display of such an event having a rapid rate of change is improved by the present non-sequential method of updating dynamic characters within a display.

In yet another embodiment of the present invention, the level of brightness in the multiplexed display is maintained during a refresh cycle. The on-time for dynamic characters may be modified and set at an appropriately lower level compared to the on-time for non-dynamic characters so as not to vary the total cycle time. The brightness of the display is sustained even while dynamic characters are being refreshed and enabled more frequently than non-dynamic characters.

These and other advantages and features of the present invention will become apparent to those skilled in the art upon review of the following detailed description of the preferred systems, methods and apparatus in conjunction with the referenced figures.

DETAILED DESCRIPTION OF THE INVENTION

For the purposes of describing the present invention, the characters which display highly dynamic events will be referred to herein as dynamic characters. However, it is to be understood that all of the characters can change at any time. Those characters with a relatively high rate of change will be referred to as dynamic while those characters having a relatively slower rate of change are referred to herein as non-dynamic characters.

Figure 1A:
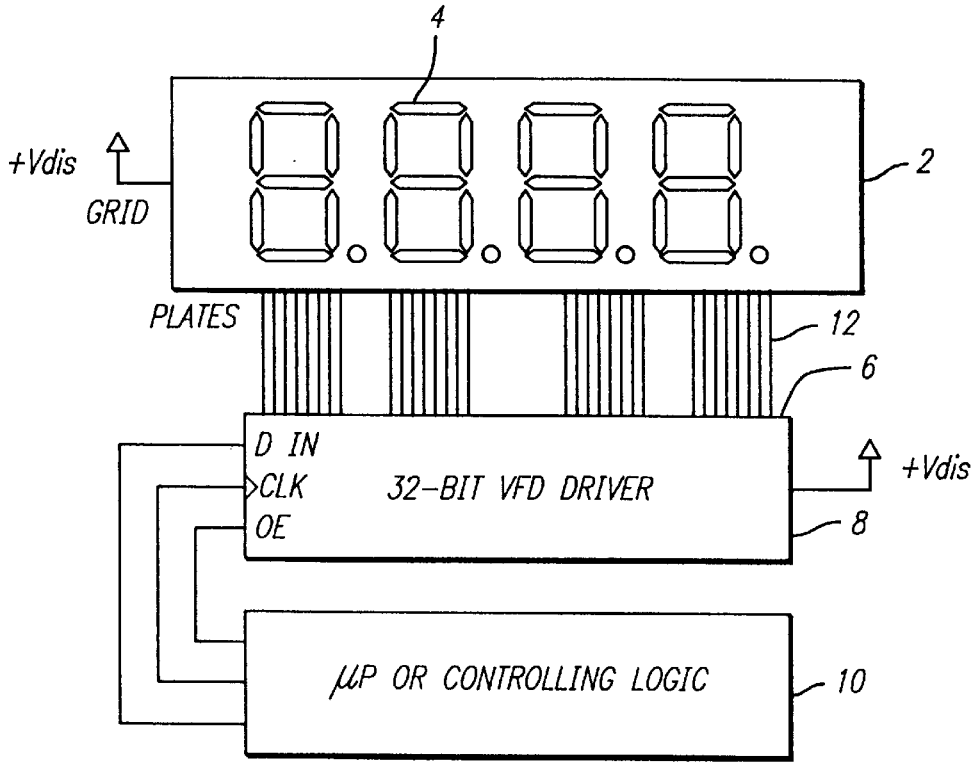
FIG. 1A is a simplified schematic drawing illustrating the direct driving method for a thirty-two segment vacuum fluorescent display.
Figure 2:
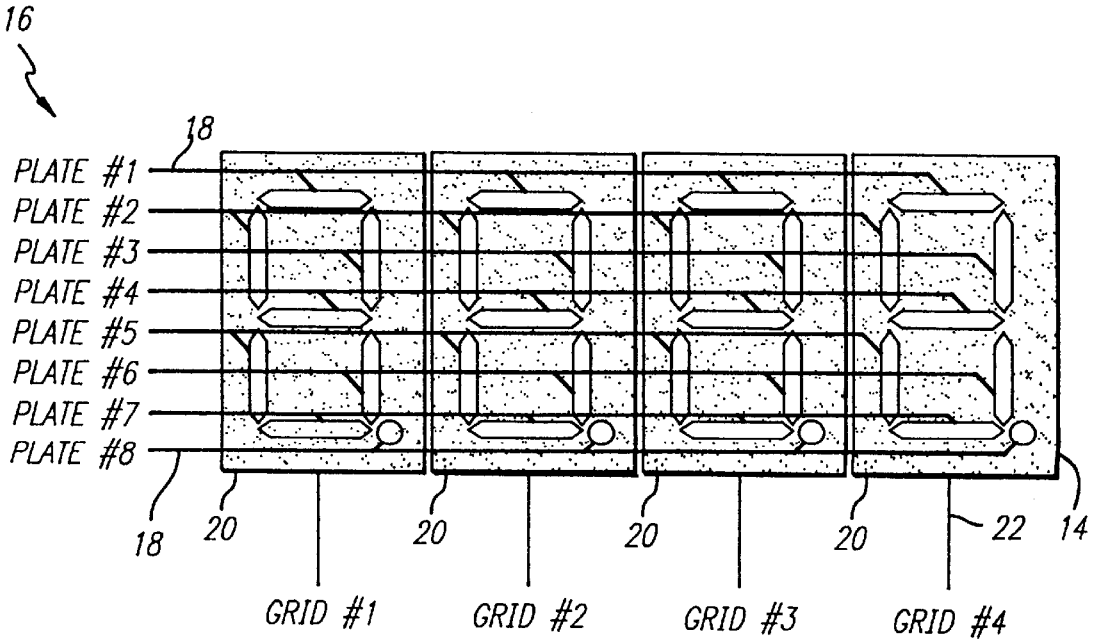
FIG. 2 is a drawing illustrating the connected segments within a four grid thirty-two display segment multiplexed display.
Figure 1B:
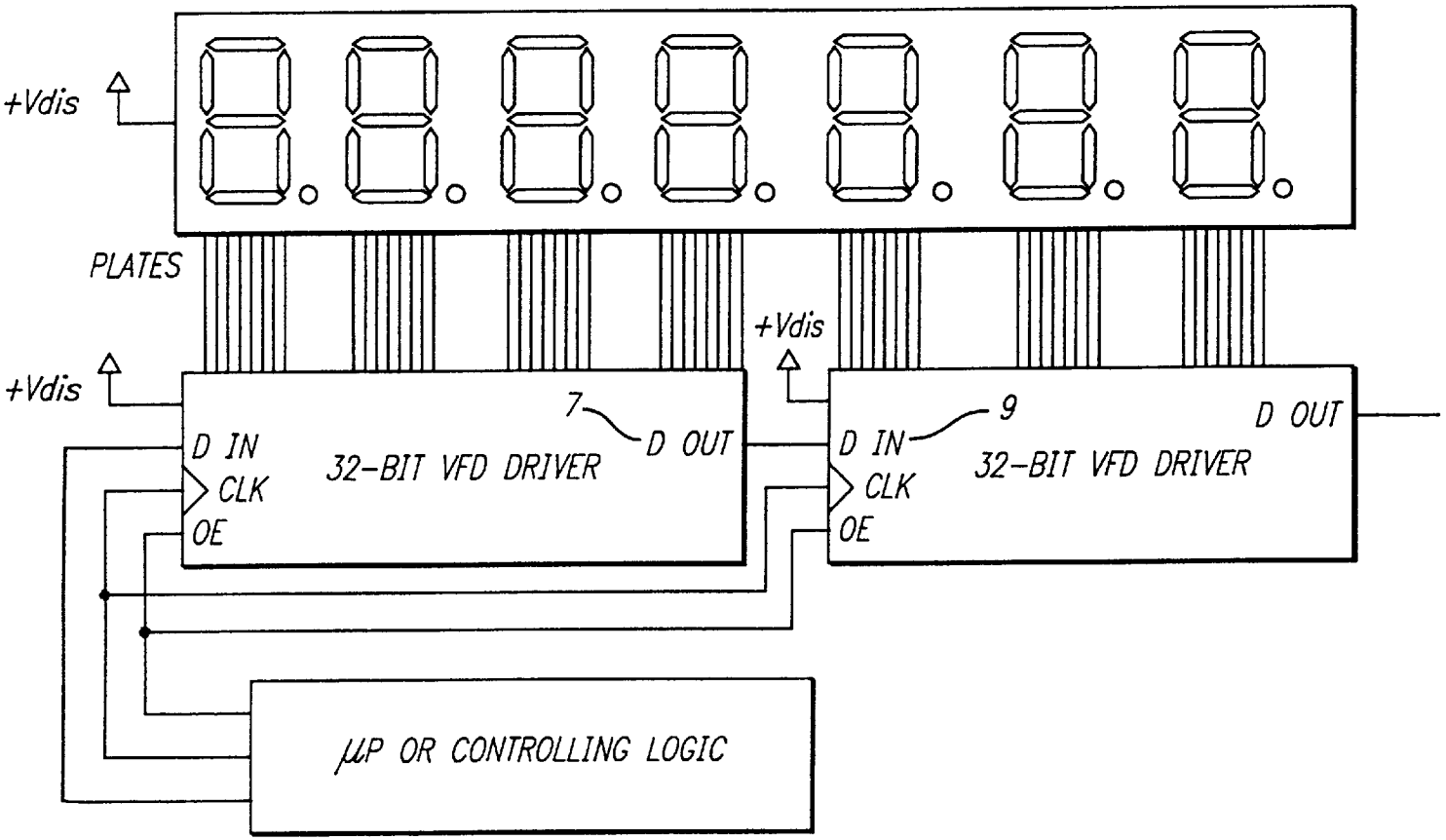
FIG. 1B is a simplified schematic drawing illustrating the cascading of drivers to control a sixty-four segment vacuum fluorescent display using the direct driving method.
Figure 3:
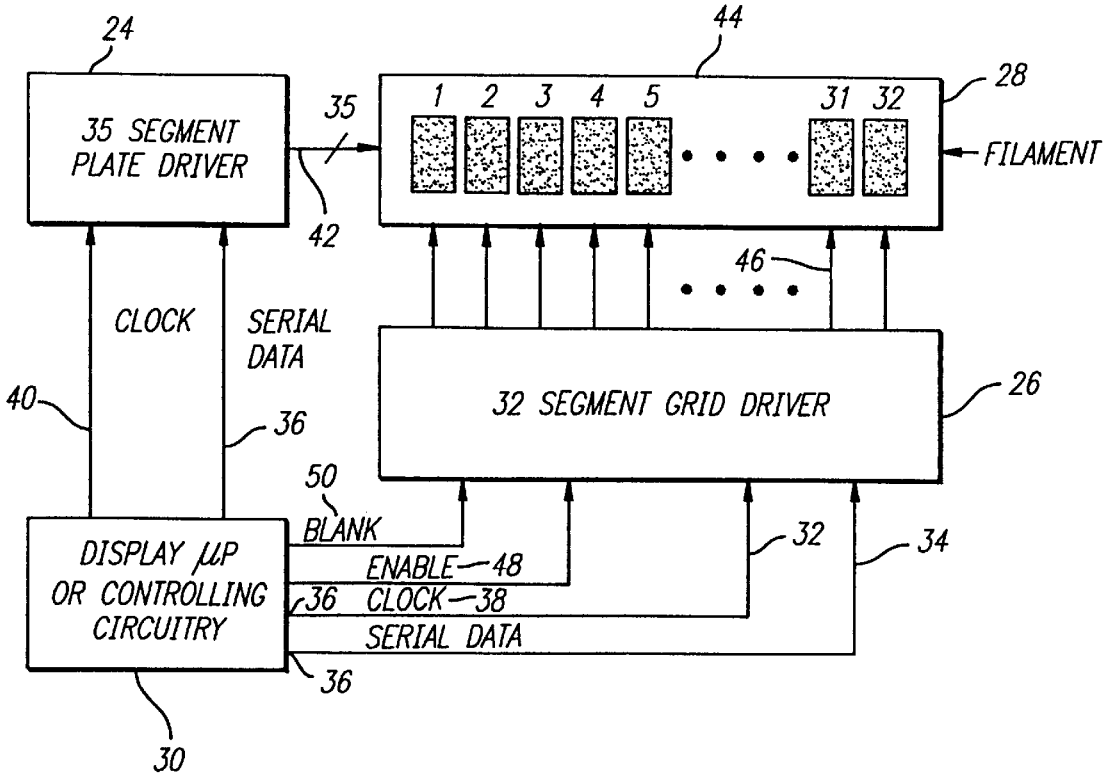
FIG. 3 is a simplified schematic drawing of a multiplexed display driving configuration for a thirty-two character dot matrix display.
Figure 5A:
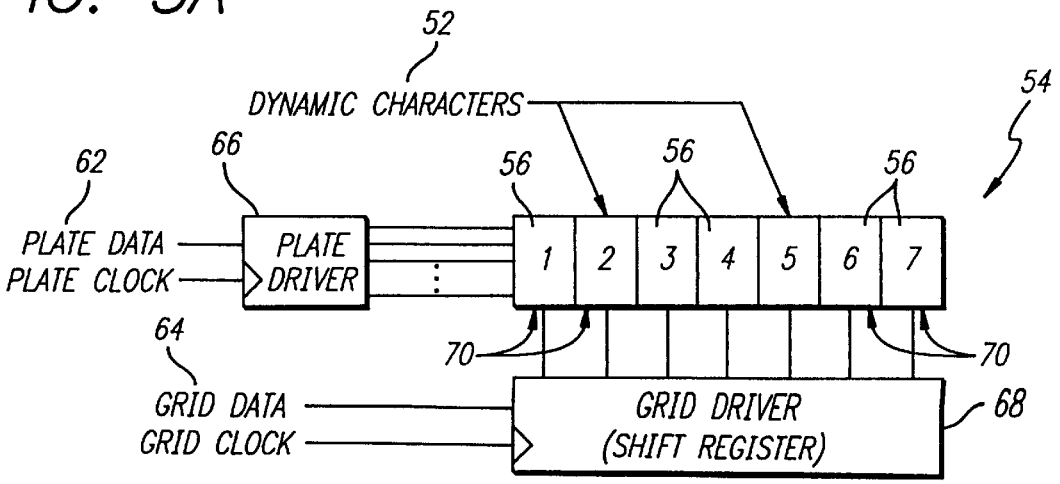
FIG. 5A is a simplified illustration of a multiplexed-timing display for seven characters with display drivers.
Figure 4:
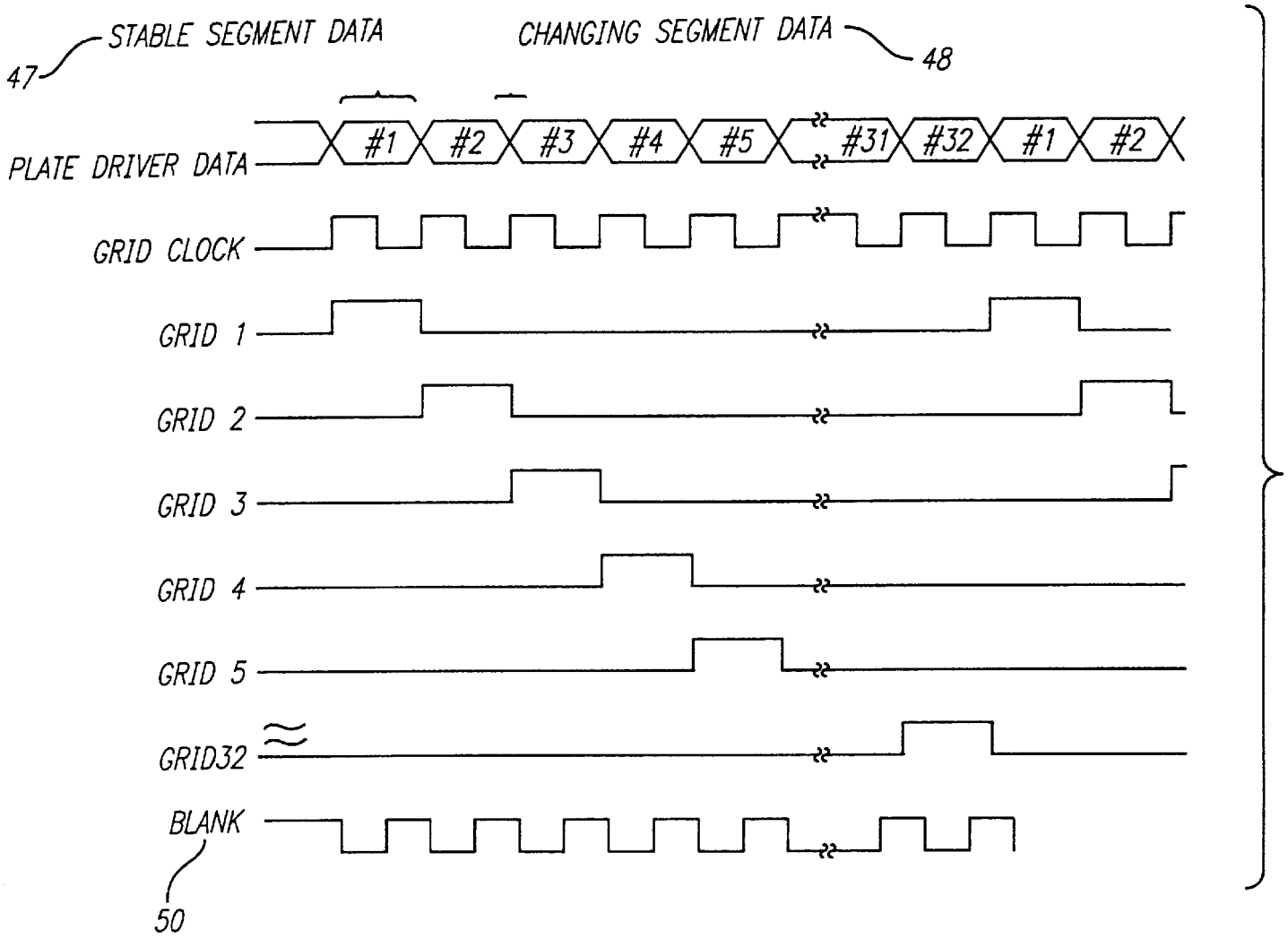
FIG. 4 is a simplified timing diagram of the display driver configuration shown in FIG. 3 illustrating the timing sequence for enabling each display character sequentially.
Figure 5B:
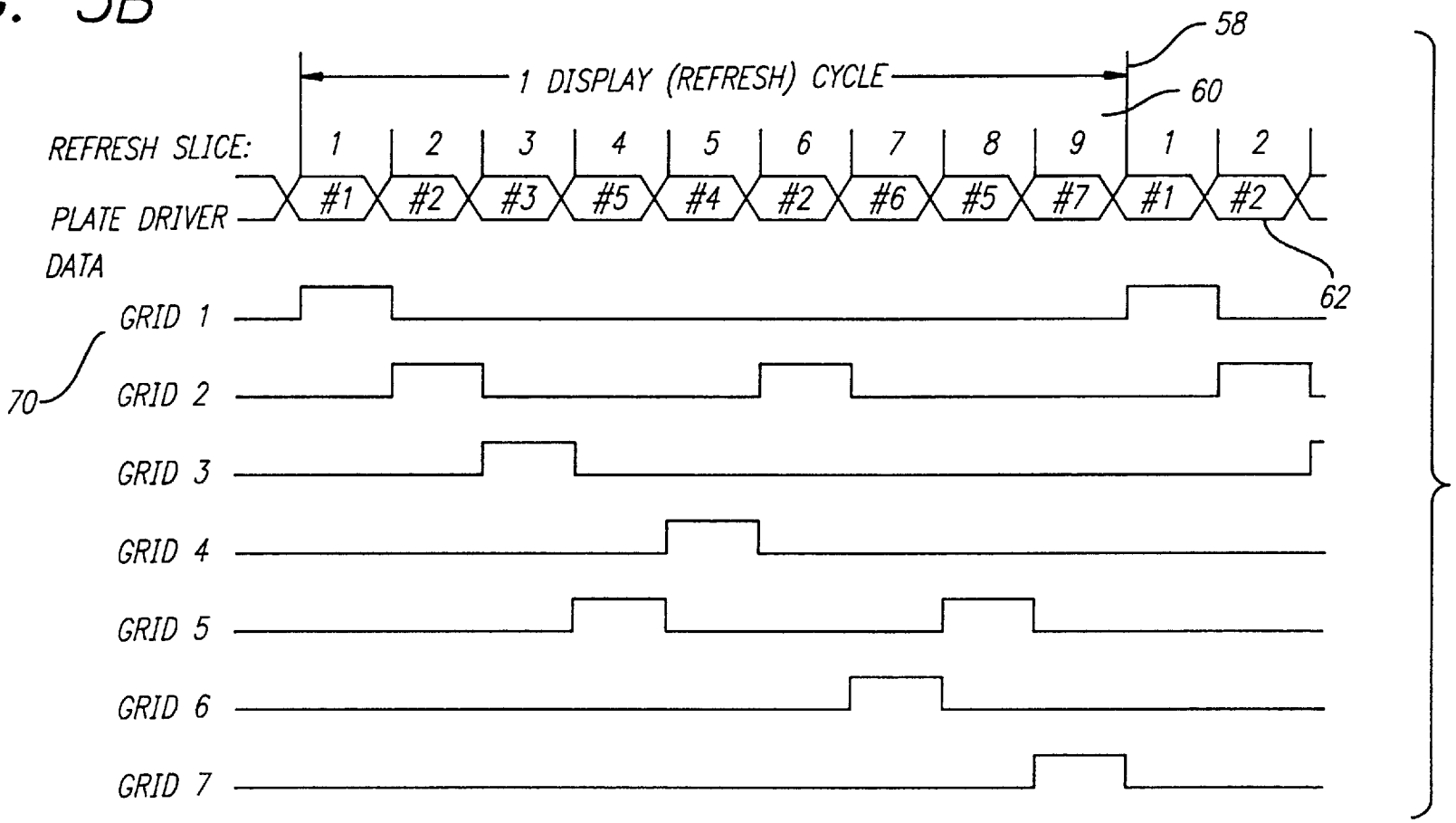
FIG. 5B is an illustration depicting a non-sequential grid update method for dynamic characters and other characters within the multiplexed display shown in FIG. 5A.
Figures 5C, 6:
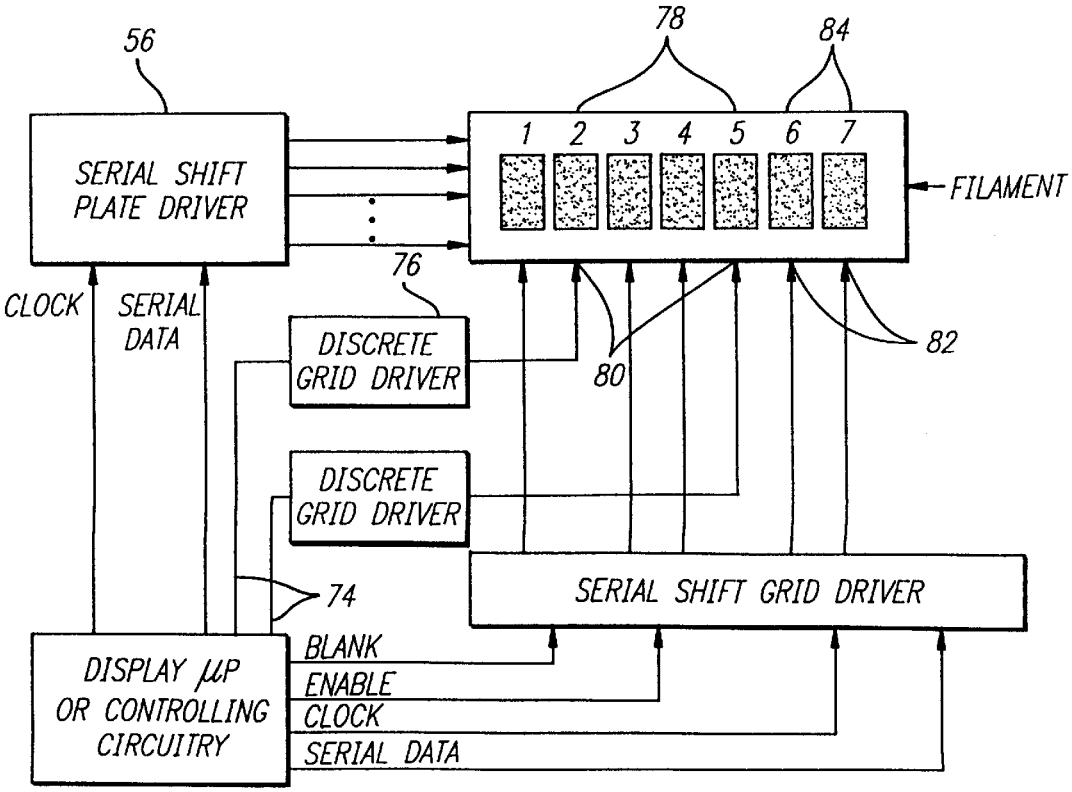
FIG. 5C is a simplified table illustrating the grid shift pattern during each refresh slice and non-sequential character enables in the display shown in FIGS. 5A and 5B.
FIG. 6 is a simplified schematic drawing of a seven grid display illustrating a non-sequential grid update method using discrete grid drivers for dynamic characters within the display.

As shown in FIGS. 5A–5C, a method is illustrated by which dynamic characters 52 in a multiplexed segment display 54 are refreshed at a higher rate than non-dynamic characters 56. In a single display cycle 58, non-dynamic characters 56 are updated once, while dynamic characters 52 are updated twice. It will be understood that for purposes of the present preferred embodiment, a display cycle 58 is the period in which all characters within a display have been enabled at least once. A subsequent display cycle or refresh cycle 58 is divided into multiple refresh slices 60 that correspond to each character enable. During the normal display blanking time in between character enables, the plate data 62 for the next character to be displayed is clocked into the plate driver 66. The grid data pattern 64 corresponding to the particular refresh slice 60 is then shifted into the grid driver 68. As a result, the desired character display sequence is obtained.

In FIG. 5A, the seven character display 54 is connected to a single plate driver 66 that drives the plate data 62 for all characters 52 and 56. A single grid driver 68 is also shown which drives each respective grid 70 high in order to enable each character displayed within a grid in a predetermined order. Within the display 54 shown in FIGS. 5A–5C, characters 1, 3, 4, 6 and 7 are identified as non-dynamic characters while characters 2 and 5 are considered dynamic characters and updated more frequently. A simplified timing illustration for one display cycle 58 in the multiplexed display 54 is shown in FIG. 5B. During each display or refresh cycle 58, segment data 62 for each character may be output to display in non-sequential order. The corresponding grid 70 is then enabled to display each character. The display or refresh cycles 58 are divided into slices 60 according to the total number of display characters 52 and 56 and the number of times dynamic characters 52 are updated. For example, as illustrated in FIGS. 5B–5C, dynamic characters 2 and 5 are updated twice during every refresh cycle. The non-dynamic display characters 1, 3, 4, 6 and 7 are updated only once during every refresh cycle. As a result, the display cycle 58 shown consists of a total of nine slices 60. FIG. 5B also shows when each respective grid 70 is driven high to enable a character in the predetermined non-sequential order.

The grid shift pattern 72 for each grid 70 that is to be driven during a particular slice 60 is also shown in FIG. 5C. The method implemented includes the steps of outputting plate data 62 for character #1 to display, and then shifting the corresponding grid shift pattern 72 into the grid driver 68 in order to drive the appropriate grid 70 for character #1 and to enable that character. Each entry under the grid shift pattern 72 column consists of two numbers (e.g. 0/1) which represent the grid driver data 64 being clocked in, and the number of clock cycles needed with that grid data, respectively. At any one time, the grid data pattern 72 consists simply of a single digit "1" and a series of "0"s, and is held in the grid shift register so as to drive the appropriate grid. A specific grid shift pattern 72 controls which character grid 70 will be enabled and driven high by the grid driver 68. As shown in FIG. 5C, the normal grid shift pattern 72 of a sequentially shifted logic "1" is modified in the present method. The character display sequence is not sequential since characters 2 and 5 represent dynamic characters 52, and are updated twice in every display cycle. For example, the grid shift pattern 72 for character #1 is simply a "1" clocked in once (1 clock cycle) during slice 1. When the grid driver is brought low during the blanking interval, the segment data 62 is changed for the next character #2. This character is then enabled by driving its respective grid 70 high in response to the corresponding grid data patterns 72 shown which is simply another single clock cycle of a "0" so as to shift the "1" along the grid shift register to the position for the second character. The same procedure is followed for enabling character #3. However, during refresh slice 4, character #5 is enabled and its corresponding grid shift pattern 72 is achieved by cycling in two "0"s, or clocking in a zero twice thereby shifting the "1" along the grid shift register two more positions to enable character #5. Continuing in the display cycle 58, in enabling character #4, a "1" is clocked in once followed by three clock cycles of a "0" in order to shift the previously shifted "1" out of the register and shift the "1" still in the register to enable character #4. During slice 6 of the display or refresh cycle 58, dynamic character #2 is updated and enabled a second time. After its updated segmented data 62 is clocked in, the corresponding grid 70 for character #2 is driven high. The grid shift pattern 72 for enabling character #2 here is achieved by clocking in a "0" twice, followed by one clock cycle of a "1," and another clock cycle with a "0" so that the grid data pattern that enables character #2 is then shifted into the grid driver 68. Non-dynamic character #6 is then enabled and followed by the enablement of updated character #5 for the second time in the display cycle 58. To complete the display cycle 58, non-dynamic character #7 is finally enabled. After each character is non-sequentially enabled during a display or refresh cycle at least once, the process is repeated again with updated data.

In order to maintain the desired level of brightness of the multiplexed display during data update, it is important to keep each of the character's "on-time" duty cycle at the designed rate. This duty cycle is the ratio of the character's on-time to the total cycle time. In the particular preferred embodiment being discussed, the display was designed for a duty cycle of ⅛. This equates to seven grids each enabled for ⅛ of the refresh cycle time, plus an additional ⅛ cycle time for display blanking in between grid enables. Due to the nature of the character display sequence in this non-sequential method, it is preferable to alter the on-time for the dynamic characters be 1/16 of the total cycle time. Because they are displayed at twice the frequency of the other characters, the desired on-time duty cycle of ⅛ is maintained. Although this non-sequential grid update method requires slightly more work on the part of the micro-controller software than the standard grid update method, it is still simpler to implement than the aforementioned software integration scheme that has been used in itself to slow the effective rate of change of the dynamic event. In any particular embodiment, wherein dynamic characters are updated and displayed more frequently, the on-time for dynamic characters may be set proportionally less in order to maintain the same duty cycle.

As illustrated in FIG. 6, a variation of this multiplexing scheme may be employed which has a simpler grid shift pattern in a configuration that uses additional control ports 74, and discrete grid drivers 76 for dynamic characters 78. In this architecture, the grid pins 80 controlling the dynamic characters 2 and 5 are driven separately from the other grid pins 82 for non-dynamic characters 1, 3, 4, 6 and 7. The data shift pattern through the grid shift register for controlling non-dynamic characters 84 is reduced to a simple shifting of a single "1" bit as in standard multiplexed display driving methods. However, a separate controller port 74 and discrete driver 76 is used to enable the dynamic characters 78 at a higher frequency than the other characters 84. The same character update sequencing and duty cycle considerations discussed above also apply to this alternate scheme. Furthermore, as explained above, a similar display blanking time is preferred in between grid enables to minimize the ghosting effect that would otherwise occur in between enables. As illustrated in FIG. 6, a number of discrete grid drivers 76 and a plate driver 86 may be used to control the non-sequential update of display characters within the multiplexed display.

Although one embodiment of the present invention has been implemented on a seven grid display as shown in FIGS. 5 and 6, two grids of which control dynamic characters, the scheme can be extended to control multiplexed displays of any size containing any number of dynamic and non-dynamic characters. Similarly, while the refresh frequency chosen here for the dynamic characters is twice that of the non-dynamic characters, a simple modification can be made to create higher relative refresh rates for dynamic characters. In a preferred embodiment, the on-time for dynamic characters may be reduced each time depending on the frequency of their character refresh and updates to maintain the same duty cycle, and in order to achieve a consistent desired brightness throughout the display update.

Figure 7:
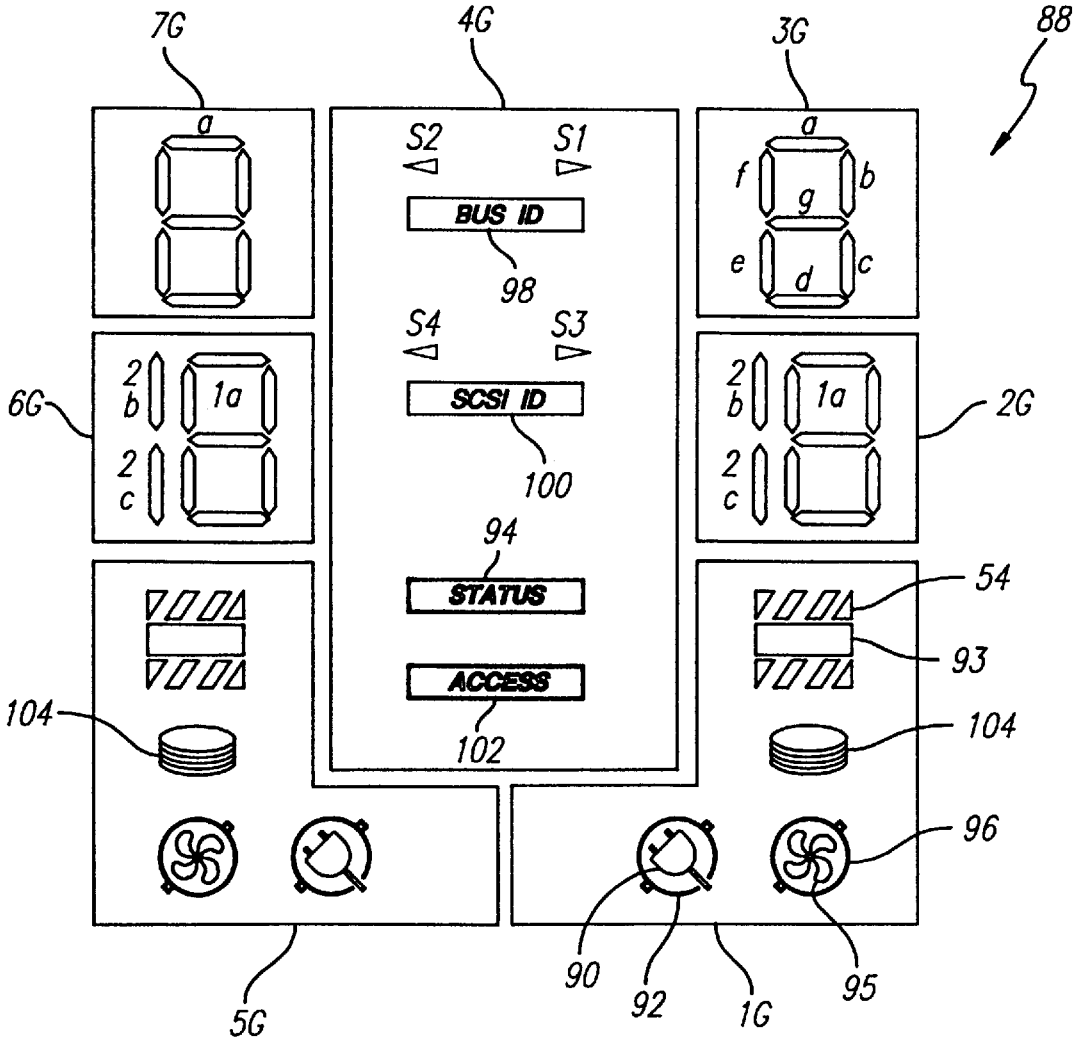
FIG. 7 is a computer display panel divided into discrete grids with various characters and segments depicting representative computer functions and status information within each grid.
Figure 8:
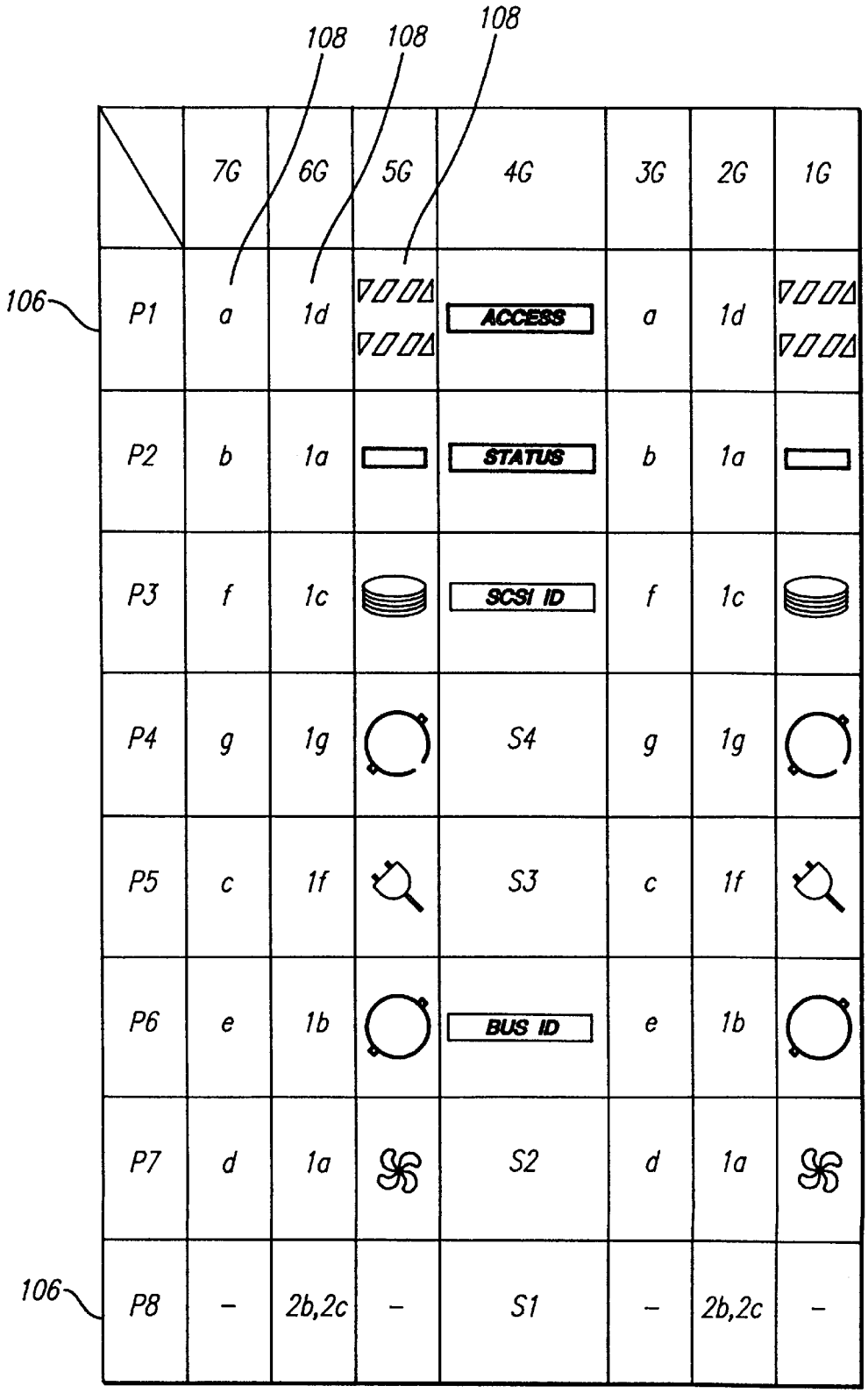
FIG. 8 is a chart illustrating the various anode connections for each segment within the display shown in FIG. 7 relative to their grid locations.

As further illustrated in FIGS. 7 and 8, another variation of the present method may be implemented with a computer display panel 88. FIG. 7 is an illustrative display panel divided into grid sections 1G through 7G. Within grids 1G and 5G, various events and computer status information are displayed and represented by characters or illustrations. For example, a plug 90 or warning icon 92 may be used to indicate the power supply status (green) 90 or any interruption of power (red) 92. Other icons may similarly be used to indicate relatively non-dynamic events such as the on/off drive status (green 93 and red 94) or the on/off fan status, 95 (green) 96 (red) respectively, during normal operation. Other non-dynamic events such as the identification of the bus 98 being utilized and the particular small computer system interface SCSI 100 may also be displayed. In particular, the dynamic event of a HDD access 102 represented by the platter icons 104 is especially notable in a computer disk drive display panel 88 to indicate when the rapidly changing activity is occurring. These characters in total are turned on and enabled when their respective segment data is clocked in, and respective grids 1G–7G are driven high. The corresponding segments for each of the characters in the multiplexed segment VFD are connected together so as to reduce the number of driver outputs. As shown in FIG. 8, various anodes for different segments 108 within each grid section are joined as plates 106. In grid 2G, 3G, 6G and 7G, numerical characters may consist of a different number of segments. Grid characters for grid 3G and 7G each consist of seven segments a–g. Each character in grids 2G and 6G consists of eight segments 1*a*–1*g* and the grouped segment labeled "2*b*, 2*c*." The characters in the grids of this display identify which SCSI bus 98 is being utilized in the system and the SCSI ID 100 assigned to the HDD utilizing the bus. These events or conditions are relatively non-dynamic. As shown in FIG. 8, however, segments 108 from other grid sections are connected together as plates P1–P8. Display characters are enabled or refreshed when updated plate data is clocked in, and the corresponding grid for that character is driven high. By implementing a variation of the present method, dynamic characters within the computer disk drive display panel 88 may be updated and refreshed more frequently than the non-dynamic characters within the display. For example, during a single display cycle, the segment data for a HDD access condition 102 represented by icons 104 may be updated more than once. Its updated data may be clocked into the plate driver and grids 1G or 5G driven high so as to refresh the HDD platter icons 104 multiple times during a single display cycle. The platter display 104 is thereby activated (updated) at a higher frequency to indicate the occurrence of this highly dynamic event. Non-dynamic characters in other grid sections are thus enabled a more limited number of times during each refresh cycle since their rate of change is relatively slower. Depending on the rate of change for each character within the display 88, a desirable display sequence may be established to non-sequentially update the display characters as needed. As shown above in other variations of the present method, grid shift patterns may be modified so as to enable characters at a predetermined frequency of occurrence and sequence. Although the method described in this invention was used to indicate both non-dynamic events and a highly dynamic event such as a HDD access, this same method can be incorporated into any multiplexed display in order to display an event that changes rapidly or has a frequency of occurrence approaching or surpassing the refresh rate of the display.

While the present invention has been described with reference to the aforementioned applications, the description of these methods is not meant to be construed in a limiting sense. Various modifications of the disclosed methods, as well as other variations of the present invention, will be apparent to a person skilled in the art upon reference to the present disclosure. For example, the use of any multiplexed display is contemplated by the disclosed method and apparatus where dynamic characters may be spaced apart, positioned consecutively, or located at any other location within a display. To this description, it is therefore contemplated that the appended claims will cover any such modifications or variations of the described methods as falling within the true scope of the present invention.

What is claimed is:

1. A method of enabling characters in a multiple character multiplexed display comprising the steps of:

enabling a first subset of the characters at a first frequency;

enabling a second subset of the characters at a second frequency different from the first frequency; and wherein the display comprises a shift register including cells, each cell of the shift register being operatively connected to a respective character, and wherein the enabling steps comprise inputting into the shift register character enabling data to non-sequentially enable the characters.

2. The method of claim 1, further comprising the step of setting a total on-time for a character in the first subset of the characters to be substantially equivalent to a total on-time for a character in the second subset of the characters over a refresh cycle.

3. A multiplexed display device, comprising:

a plurality of display characters;

a display driver means for enabling a first subset of the display characters at a first frequency and enabling a second subset of the display characters at a second frequency; and wherein the display device further comprises a shift register including cells, each cell of the shift register being operatively connected to a respective character, and wherein the display driver means being configured to input into the cells of the shift register non-sequential character enabling data.

4. The device of claim 3, wherein a total on-time for a display character in the first subset of the display characters is substantially equivalent to a total on-time for a display character in the second subset of the display characters over a refresh cycle.

5. A display device, comprising:

a multiple character multiplexed display;

a first character driver connected to a first subset of display characters and enabling the first subset of display characters at a first frequency; and at least one additional character driver connected to a second subset of display characters and enabling the second subset of display characters at a second frequency different from the first frequency.

6. A display device as recited in claim 5, wherein the first and at least one additional character driver are grid drivers.

7. A display device as recited in claim 5, wherein the display is a vacuum fluorescent display further comprising a plate driver for inputting display character data.

8. The device of claim 5, wherein a total on-time for a display character in the first subset of display characters is substantially equivalent to a total on-time for a display character in the second subset of display characters over a refresh cycle.

* * * * *